United States Patent [19]

Engelstein

[11] 4,253,258

[45] Mar. 3, 1981

[54] PHOTO ALBUM FOR INSTANT PHOTOS

[75] Inventor: Harold Engelstein, Far Rockaway, N.Y.

[73] Assignee: NB Jackets Company, Chicago, Ill.

[21] Appl. No.: 43,327

[22] Filed: May 29, 1979

[51] Int. Cl.[3] ..... G09F 1/10

[52] U.S. Cl. ..... 40/158 R

[58] Field of Search ..... 40/391, 534, 158, 20 R, 40/124, 405, 497, 399, 388; 24/67 AR

[56] References Cited

U.S. PATENT DOCUMENTS

| | | | |
|---|---|---|---|
| 140,245 | 6/1873 | Clemens | 40/158 X |
| 1,604,028 | 10/1926 | Dinkler | 40/534 |
| 2,096,559 | 10/1937 | Riley | 40/158 R X |
| 2,149,489 | 3/1939 | Ainsworth | 40/534 |
| 2,304,158 | 12/1942 | Flood | 40/534 |
| 2,610,421 | 9/1952 | Horn | 40/158 R X |
| 3,503,835 | 3/1970 | Hermann | 40/158 X |
| 3,581,423 | 6/1971 | Mascolo | 40/158 X |
| 3,847,325 | 11/1974 | Nasalki | 40/158 X |
| 4,048,740 | 9/1977 | Zitzelberger | 40/158 X |
| 4,106,230 | 8/1978 | Martinez | 40/391 |

FOREIGN PATENT DOCUMENTS

| | | | |
|---|---|---|---|
| 1064546 | 4/1957 | United Kingdom | 40/391 |

*Primary Examiner*—Gene Mancene
*Assistant Examiner*—Wenceslao J. Contreras
*Attorney, Agent, or Firm*—Michael Ebert

[57] ABSTRACT

An album for "instant" positive photos of the type in which the film is held in a mat forming a frame therefor and having upper and lower margins. The album is constituted by a set of mounting boards which are hinged to a carrier card at stepped positions thereon or which are bound together in a loose-leaf stack. Each mounting board has a band of pressure-sensitive adhesive material extending across both the front and back faces at corresponding positions thereon, the bands being protectively covered by removable liners. In installing photos in the album, the upper rear margin of a photo is pressed onto the front face band of the board to adhesively secure the photo thereon, a second photo being secured in the same manner to the back face band whereby each mounting board carries a pair of photos in back-to-back relation.

3 Claims, 12 Drawing Figures

15
17
15
10
18
20
15
17
17
15

5
17
19
19A
18
15
5

Fig. 8.
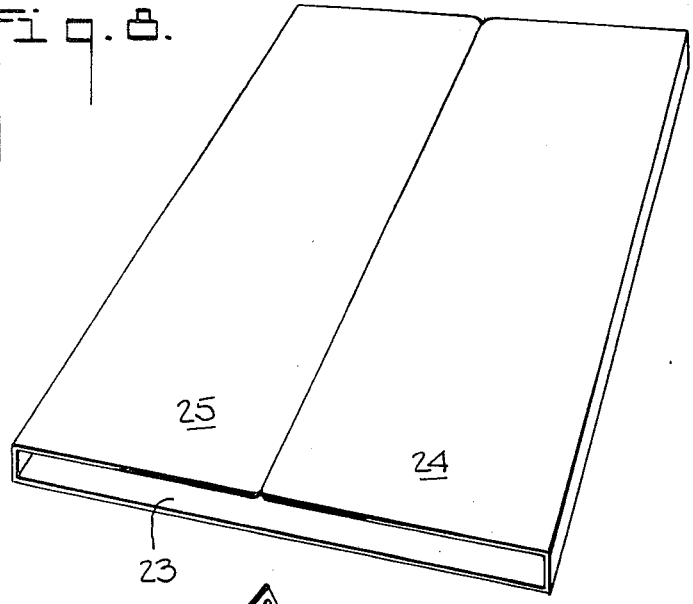
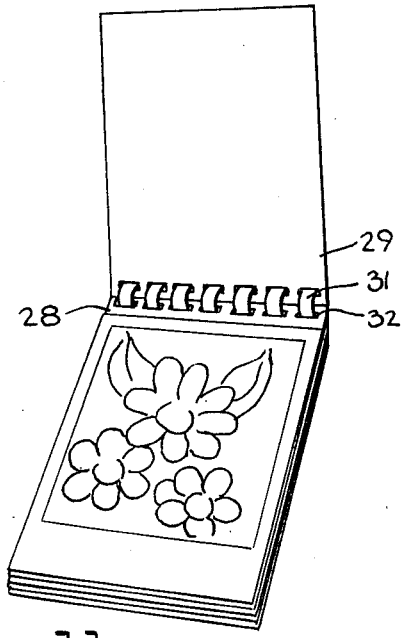
Fig. 11.
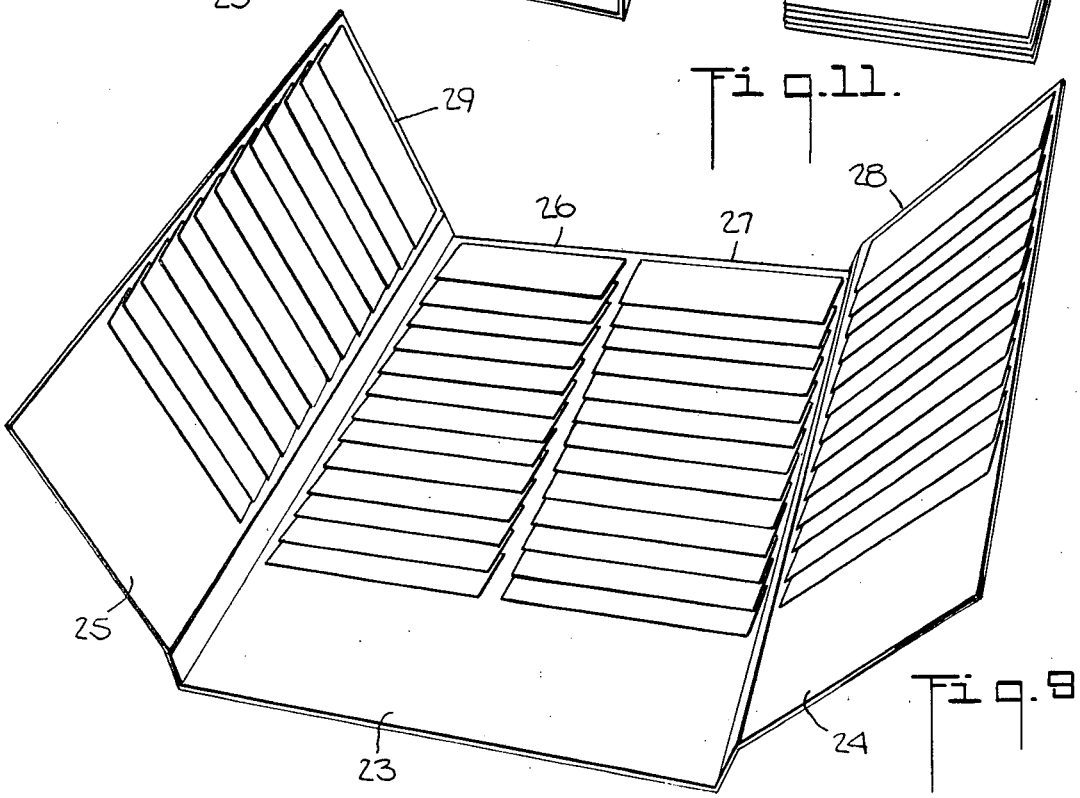
Fig. 9.
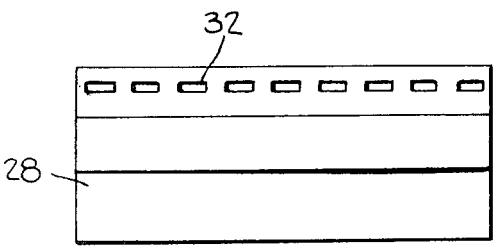
Fig. 12.
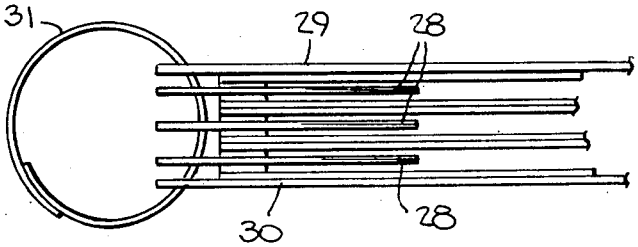
Fig. 10.

PHOTO ALBUM FOR INSTANT PHOTOS

BACKGROUND OF THE INVENTION

This invention relates generally to photo albums of the flip or book type, and more particularly to an album in which the photos are directly adhered to the mounts of the album to assume a step or stack formation.

In order to protectively store photographic prints in an orderly sequence, it is conventional to make use of so-called flip-type photo albums in which the prints are inserted within hinged jackets arranged in two parallel rows, the jackets in each row being progressively stepped. The two rows of hinged jackets are mounted on the inner surfaces of the front and back covers of the album.

In one known form of flip album, each jacket is constituted by a transparent plastic sleeve whose upper margin is hinged by a strip of tape to a baseboard, the sleeve being divided by a partition card into front and rear compartments for receiving a pair of photo prints in back-to-back relation, such that the front photo in a selected hinged jacket in the stepped row can be seen by raising the jackets which overlap the selected jacket and the rear photo in the same jacket can be seen by flipping over the jacket.

A flip album of this type is relatively costly to fabricate, for it not only involves the production of album covers and jackets, but also requires base boards onto which the sleeves may be hinged by tape at offset positions, the boards thereafter being bonded to the covers. Though the transparent plastic jackets serve to protect the surfaces of the photos inserted therein from scratches and smudges, their inherently glossy finish makes it difficult in some instances to see the prints clearly.

In recent years, Polaroid, Eastman Kodak and other large companies have been marketing cameras which produce "instant" positive photos, rather than negative film that requires development and printing. Such finished photos are discharged from the camera in a protective paper mat which frames the picture film and includes a narrow upper margin and a relatively broad lower margin onto which one may apply identifying data. The surface of these instant pictures is such that it is resistant to scratching or smudging and therefore does not require a protective sleeve. Yet with flip albums of the type heretofore available, it is still necessary to insert these instant pictures in transparent jackets, which to a degree cloud the picture.

It is also known to provide albums in book filler form, the album being constituted by a stack of transparent jackets which are held together in a loose-leaf binder. The instant photos in this instance are inserted in the front and rear compartments of the jackets and are viewable as book pages. Here, too, the use of transparent jackets is a drawback, for the jackets interfere with the clarity of the photos and also add to the thickness of the book.

SUMMARY OF INVENTION

In view of the foregoing, the main object of this invention is to provide a flip-type album or book filler in which "instant" photos stored therein are directly attached to mounting boards to assume in the case of a flip-type album a stepped formation and in the case of a filler book, a stacked formation.

More particularly, it is an object of this invention to provide mounting boards which dispense with the need for transparent jackets, each board having coated on its front and back face a band of pressure-sensitive adhesive material, a pair of photos being secured in back-to-back relation on the bands.

Also an object of the invention is to provide a photo album or book filler of simple, low-cost and high-strength construction which makes possible the quick insertion of photos to be stored, the album or book protectively housing the photos.

A significant advantage of a book filler in accordance with the invention is that one may provide in conjunction with each standard cartridge of "instant" film which has a ten-picture capacity a companion book filler having a stack of five mounting boards, whereby the photos derived from the cartridge may be immediately stored in the book. Because of this one-to-one relationship, one may create a library of photos in which each book identifies the pictures taken from its related cartridge.

Briefly stated, these objects are attained in books, fillers or albums defined by a set of mounting boards which are hinged to a carrier card at stepped positions thereon or which are bound together in a loose-leaf stack. Each mounting board has a band of pressure-sensitive adhesive material coated across both the front and back faces thereof at corresponding positions, the bands being protectively covered by removable liners.

In installing photos, the upper rear margin of one photo is pressed onto the front face band of the board to adhesively secure the photo thereto, a second photo being secured in the same manner to the back face band whereby each mounting board carries a pair of photos in back-to-back relation.

OUTLINE OF DRAWINGS

For a better understanding of the invention as well as other objects and further features thereof, reference is made to the following detailed description to be read in conjunction with the accompanying drawings, wherein:

FIG. 8 is a perspective view of a flip-type album in triptych form;

FIG. 9 shows the triptych album with its flaps open;

FIG. 10 is a side view of a book filler for photos in accordance with the invention;

FIG. 11 shows the book filler in perspective with its cover raised; and

FIG. 12 shows a single mounting board of the book filler.

DESCRIPTION OF INVENTION

First Embodiment

Figure 1:
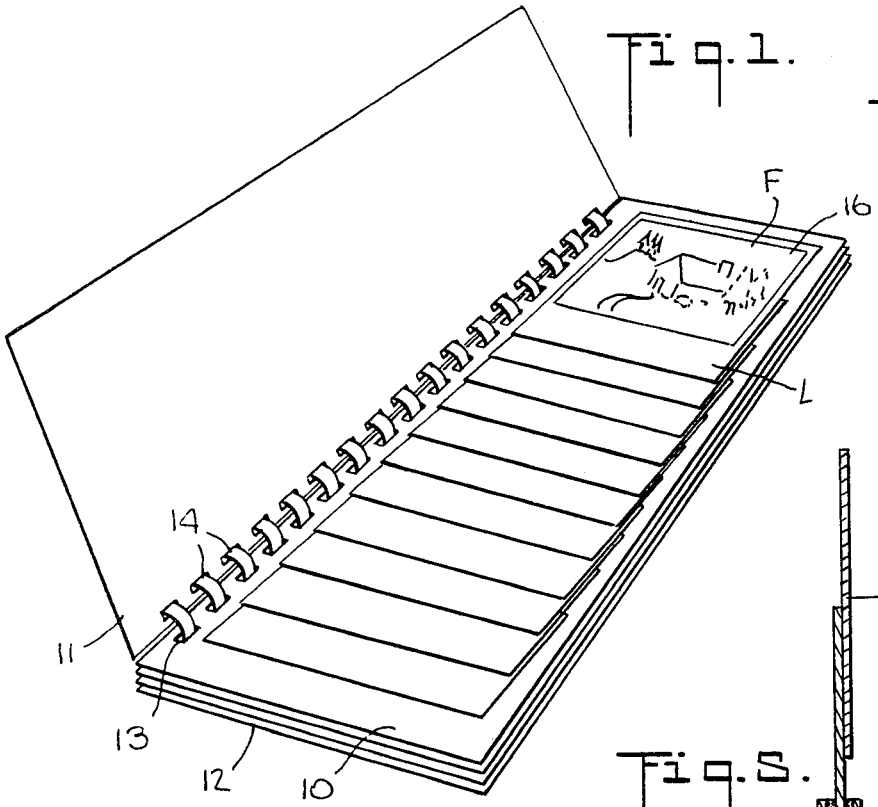
FIG. 1 is a perspective view of a flip-type photo album in accordance with the invention.

Referring now to FIG. 1, there is shown a flip-type album in accordance with the invention, the album being constituted by a plurality of carrier cards 10 formed of cardboard or synthetic sheet material serving as the pages of the album, the cards being bound between the front and rear covers 11 and 12. Binding is effective by identical rows of perforations 13 along the edge of each card and corresponding rows of perforations along the covers, a plastic spiral 14 being threaded through the perforations.

As best seen in FIGS. 2 to 6, hingedly connected to each page is a vertical set of equi-spaced mounting boards 15 to each of which is adhesively attached a pair of instant photos, the spacing or pitch between the boards being such that the photo-pairs are fanned out in stepped relation with only the lower margins thereof exposed except for the uppermost photo which is fully exposed.

Each photo 16, as best seen in FIG. 1, is constituted by a positive film F held within a mat M serving as a rectangular frame therefor and provided with a narrow upper margin U and a broader lower margin L.

Mounting board 15 has a strip 17 of adhesive tape attached to the upper margin thereof, the tape extending beyond the margin and being adhered to the carrier card 10 to provide a board hinge. Coated on the front face of board 15 is a band of pressure-sensitive adhesive material which is covered by a protective linear 14 whose width is greater than the adhesive band to create a tail 19A which may be easily grasped by the fingers to peel off the liner. Similarly coated on the back face of board 15 is a correspondingly-positioned band 20 of pressure-sensitive adhesive material which is protectively covered by a removable liner 21 having a tail 21A.

The two adhesive bands are disposed adjacent the upper edge of the board to leave a clear board surface therebelow. In practice, instead of directly coating the board with adhesive, one may use a double-faced adhesive tape to form the band, one face adhering to the board, the other providing the required band.

Figure 6:
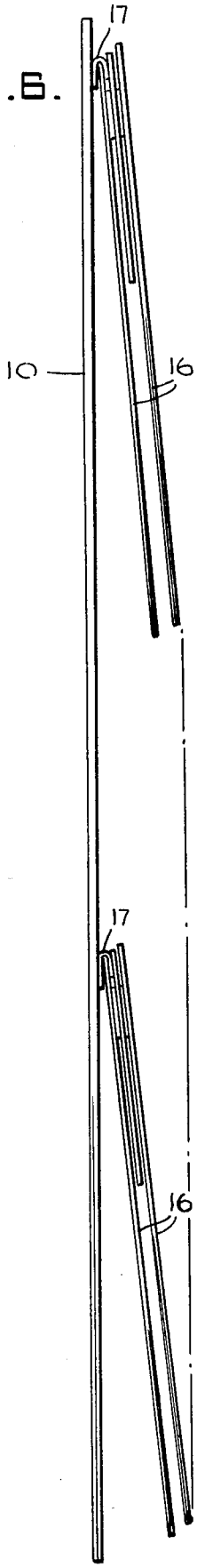
FIG. 6 is a side view of the page showing pairs of photos in back-to-back relation secured to the uppermost and lowermost mounting boards.
Figure 5:
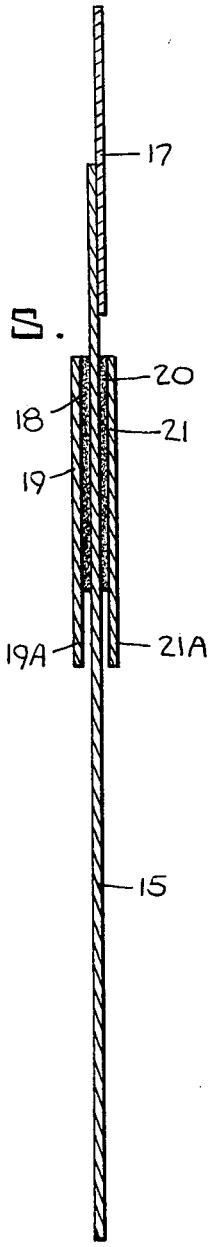
FIG. 5 is a transverse section taken in the plane indicated by line 5—5 in FIG. 4.

A photo 16 is attached to the hinged mounting boards by first removing the liner from the adhesive band. After aligning the upper edge of the photo with the upper edge of the mounting board, which is of the same width as the photo, one then presses the rear of the photo against the adhesive band. By so attaching photos to the front and back face bands of the board, the photos are placed in back-to-back relation, as shown in FIG. 6.

Figures 2, 3, 4:
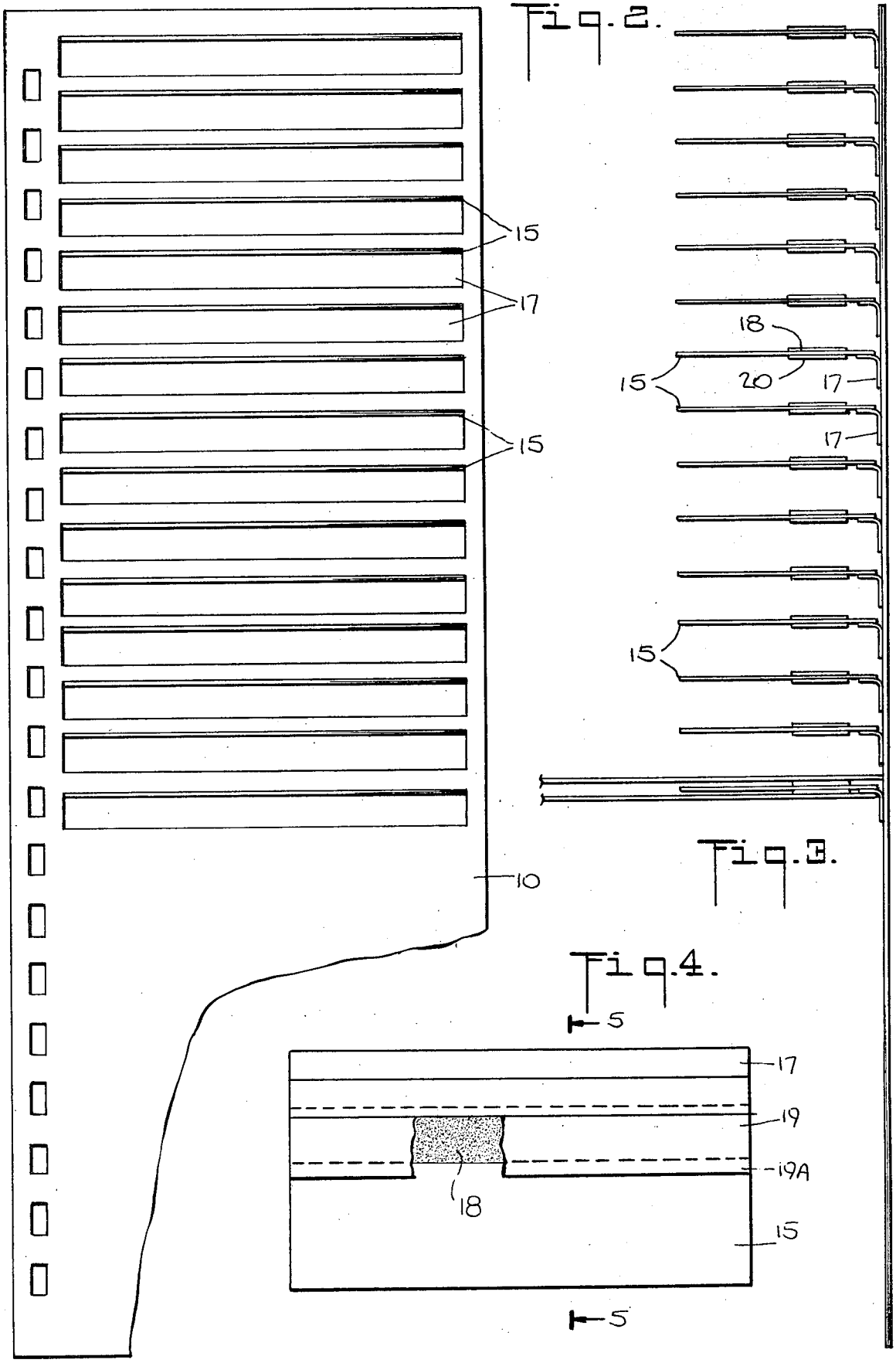
FIG. 2 is a plan view of a carrier card or page from the album, the mounting boards hinged thereon being extended at right angles to the page.
FIG. 3 is a side view of the same page.
FIG. 4 is a plan view of one of the mounting boards.

Thus when a card carrier is provided, as shown in FIGS. 2 and 3, with a set of fifteen mounting boards, it then has a capacity of 30 photos, each hinged pair being viewable by flipping over the board. Thus with a relatively compact flip-type album having, say, five pages, the album has a capacity of 150 photos.

Since Polaroid "instant" photos have a width of $4\frac{1}{8}$ inches, the mounting boards have the same dimension. With Kodak or other "instant" photos having different widths, use is made of mounting boards in matching sizes. In practice the boards have a length of $1\frac{3}{4}$ inches, which falls well short of the length of the photos, yet affords a good backing for the photos attached thereto. And since the mat of the "instant" photos is white, the carrier cards and the boards are also preferably white in color.

Second Embodiment

Figure 7:
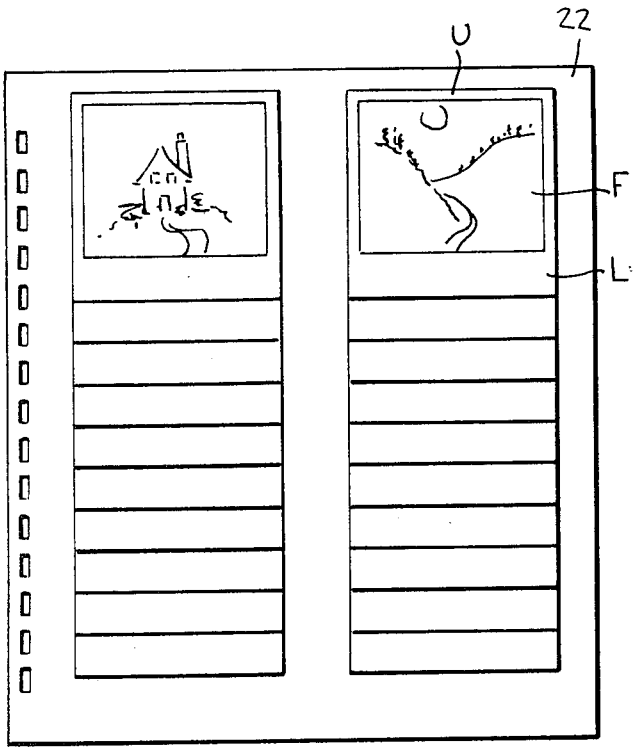
FIG. 7 shows a single page from a double size album of the flip type.

FIG. 7 shows a single page of an album of the type shown in FIG. 1 except that in this instance the carrier card 22 it twice the width of carrier card 10 in FIG. 1, making it possible to have two parallel sets of mounting boards per page.

In this way, assuming fifteen mounting boards in each set, each carrier card then has a capacity of 60 photos; for each mounting board has a pair of photos attached thereto in back-to-back relation.

Third Embodiment

The album shown in FIG. 9 is in triptych form with a central panel 23 and a pair of side panels or flaps 24 and 25 hinged to opposite edges of the central panel, the side panel dimensions each being one-half that the central panel.

Bonded to the central panel is a pair of parallel carrier cards 26 and 27, each having a set of mounting boards hinged thereto at equi-spaced positions. Bonded to the side panels are single carrier cards 28 and 29 each having a like set of mounting boards hinged thereto.

Thus when the flaps are closed, as shown in FIG. 8, the photos attached to the mounting boards are protectively shielded; and when the flaps are open the user has direct access to the four carrier cards for flip-type examination of the photos carried thereby.

Fourth Embodiment

In the book filler shown in FIGS. 10, 11 and 12, a stack of like mounting boards 28, one of which is shown in FIG. 12, is bound between the top and bottom covers 29 and 30 of the book by means of a plastic spiral 31 threaded through the perforation row 32 punched along the edge of the covers and the mounting boards.

Each board is provided at its front and back face with a band of pressure-sensitive adhesive material and a removable protective liner. Thus each board supports a pair of photos in back-to-back relation.

Book fillers may be used in conjunction with "instant" film cartridges, so that for a standard cartridge having ten pictures, a book filler may be provided with five board to support five pairs of photos in back-to-back relation.

While there have been shown and described preferred embodiments of a photo album for instant photos in accordance with the invention, it will be appreciated that many changes and modifications may be made therein, without, however, departing from the essential spirit thereof. While the album, filler book or flip index card has been described for use in conjunction with "instant" photos in which the film is held is a mat, it is also usable with unmatted photos, such as regular snapshots which are in the form of glossy prints which require no protective transparent envelope for inclusion in an album or other storage device. In this case, the upper rear end portions of a pair of photos are adhered to the front and back face adhesive bands of each mounting board. It is also to be understood that it is possible, after photos have been attached to the mounting boards to subsequently peel off the photos from the boards if, for example, one wishes to rearrange the sequence of photos contained in the album.

I claim:

1. An album or book filler for storing "instant" photos of the type in which a positive film is held in a mat forming a frame therefor and having upper and lower margins, said photos all being of the same size and having predetermined rectangular end and side dimensions, said album or book comprising a set of like mounting boards, each having a length equal to said end dimension and a width much shorter than said side dimension, each board having a band of pressure-sensitive adhesive material extending across both the front and back faces thereof at corresponding positions, each band being protectively covered by a removable liner, whereby a first photo may be attached to the board by pressing the upper end rear portion thereof against the front face band and a second photo may be attached by pressing the upper end rear portion thereof against the back face band to provide a pair of photos in back-to-back relation, the board acting as a backing for said photos, the mounting boards in said set being hinged at equi-spaced positions onto a carrier card each by an adhesive tape, a portion of which is adhered to said board and the remaining portion to said card, the spacing between boards being such that the pairs of photos thereon overlap each other with only the lower margins exposed.

2. An album or book as set forth in claim 1, comprising a plurality of said cards provided at their edges with like rows of perforations to constitute pages which are sandwiched between front and rear covers having matching rows of perforations, and binding means passing through said perforations.

3. An album for storing photos all of the same size, said photos having predetermined rectangular end and side dimensions, the album comprising a set of like mounting boards whose length corresponds to said end dimension of the photos and whose width is substantially shorter than the side dimension thereof, each board having on both the front and back faces thereof pressure-sensitive adhesive material protectively covered by a removable liner whereby a first photo may be attached to the board by pressing the rear upper margin thereof against the adhesive material on the front face and a second photo may be attached by pressing the rear upper margin thereof against the adhesive material of the back face to provide a pair of photos in back-to-back relation on each board which acts as a supportive backing therefor, the mounting boards being hinged at equi-spaced positions onto a carrier card by an adhesive tape, a portion of which is adhered to the board, the remaining portion to said card, the spacing between the hinged boards in the set being such that the pairs of photos supported thereby overlap each other with only the lower margins exposed.

* * * * *